US005740798A

United States Patent [19]

McKinney

[11] Patent Number: 5,740,798

[45] Date of Patent: Apr. 21, 1998

[54] DISPOSABLE NASAL BAND FILTER

[76] Inventor: Stella H. McKinney, 2126 Country Club Dr., Sugarland, Tex. 77478

[21] Appl. No.: 737,105

[22] PCT Filed: Apr. 21, 1995

[86] PCT No.: PCT/US95/04918

§ 371 Date: Oct. 22, 1996

§ 102(e) Date: Oct. 22, 1996

[87] PCT Pub. No.: WO95/28992

PCT Pub. Date: Nov. 2, 1995

Related U.S. Application Data

[63] Continuation-in-part of Ser. No. 231,156, Apr. 22, 1994, abandoned.

[51] Int. Cl.[6] ..... A62B 7/10

[52] U.S. Cl. ..... 128/206.18; 128/206.14; 128/206.25

[58] Field of Search ..... 128/206.11, 206.18, 128/207.18, 206.14, 206.25

[56] References Cited

U.S. PATENT DOCUMENTS

| | | | |
|---|---|---|---|
| 630,242 | 8/1899 | Lakin | 128/206.13 |
| 1,097,538 | 5/1914 | Cordova | 2/427 |
| 2,097,846 | 11/1937 | Strauch | 128/204.13 |
| 2,494,406 | 1/1950 | Reitano | 128/206.13 |
| 2,572,254 | 10/1951 | Folberth | 128/206.18 |
| 2,890,695 | 6/1959 | Safstrem | 128/206.11 |
| 3,463,149 | 8/1969 | Albu | 128/204.12 |
| 3,603,315 | 9/1971 | Becker, III | 128/206.19 |
| 3,664,335 | 5/1972 | Boucher et al. | 128/206.19 |
| 3,699,958 | 10/1972 | Szucs | 604/304 |
| 3,747,597 | 7/1973 | Olivera | 128/206.11 |
| 3,802,426 | 4/1974 | Sakamoto | 128/206.11 |
| 3,884,223 | 5/1975 | Keindl | 128/206.11 |
| 3,905,335 | 9/1975 | Kapp | 128/206.11 |
| 4,030,491 | 6/1977 | Mattila | 128/206.11 |
| 4,052,983 | 10/1977 | Bovender | 128/204.12 |
| 4,220,150 | 9/1980 | King | 128/206.11 |
| 4,240,420 | 12/1980 | Riaboy | 128/206.14 |
| 4,354,489 | 10/1982 | Riaboy | 128/206.14 |
| 4,984,302 | 1/1991 | Lincoln | 2/206.11 |
| 5,392,773 | 2/1995 | Bertrand | 128/206.18 |

FOREIGN PATENT DOCUMENTS

| | | |
|---|---|---|
| 945897 | 5/1949 | France . |
| 1354867 | 2/1964 | France . |

*Primary Examiner*—Aaron J. Lewis
*Attorney, Agent, or Firm*—Mark A. Oathout

[57] ABSTRACT

The invention relates to a disposable nasal band filter (20) to be applied to a user's nose having a filter element (22) which seals around and surrounds the nostrils and two sheer adhesive strips (**24*a*,24*b*) which overlap the filter element and adhere to a user's nose. The filter element includes an elastic strand (28) which is stitched around the outer edge (23*a*,23*d***) of the filter element so that the filter element will grasp, seal around and snuggle a user's nose when the band is applied.

5 Claims, 3 Drawing Sheets

DISPOSABLE NASAL BAND FILTER

This application is a continuation in part of prior U.S. application Ser. No. 08/231,156, filed Apr. 22, 1994, abandoned.

BACKGROUND OF THE INVENTION

Individuals who are outside or exposed to various work environments can encounter a variety of air borne irritants. For example, walkers and joggers can be exposed to pollution, pollen, exhaust, insects, dust, smoke, bacteria, viruses, etc. There are also numerous other examples of individuals who are exposed to air irritants such as people who work in the sanitization industry, insect infested environments, dusty or sandy environments, painters, a chemical industry, construction workers, bike riders, skiers, fertilizing, crop dusting, exterminating and the list goes on. Animals and birds suffer as well from air borne irritants such as sand and dust including the other irritants and problems mentioned above which can lead to ailments such as lung disease. Moreover, negative effects are enhanced on individuals, animals and birds with respiratory conditions such as allergies and lung problems.

A variety of breathing filter devices have been available in the past, however, these devices have a variety of shortcomings, including devices which are too expensive to dispose of after one use or are not readily washable once they are covered with an irritant such as pollen, dust, mucus, devices which inhibit breathing, devices which are cost prohibitive, those which may not be sturdy specially in a moist environment, devices which are cumbersome to wear, the device may be unsightly to wear, etc.

The need therefore exists for a disposable breathing filter which is easy to apply, comfortable to wear, easy to remove, manufactured with inexpensive materials by an inexpensive process, disposable, washable, durable (especially for moist environments), lightweight, breathable, and yet warm.

SUMMARY

The invention provides a disposal nasal band filter designed to meet the needs mentioned above. The filter can be worn by individuals and animals.

The invention is to be applied to a user's nose and includes a filter element which seals around and surrounds the nostrils and two sheer adhesive strips which overlap the filter element and adhere to the user's nose. The filter element includes an elastic strand which is stitched around the outer edge of the filter element so that the filter element will grasp, seal around and snuggle the user's nose when the band is applied. Prescriptive or non-prescriptive medication can be added to the filter element allowing the filter to function as a Delivery System to the respiratory system.

DETAILED DESCRIPTION

Figure 1:
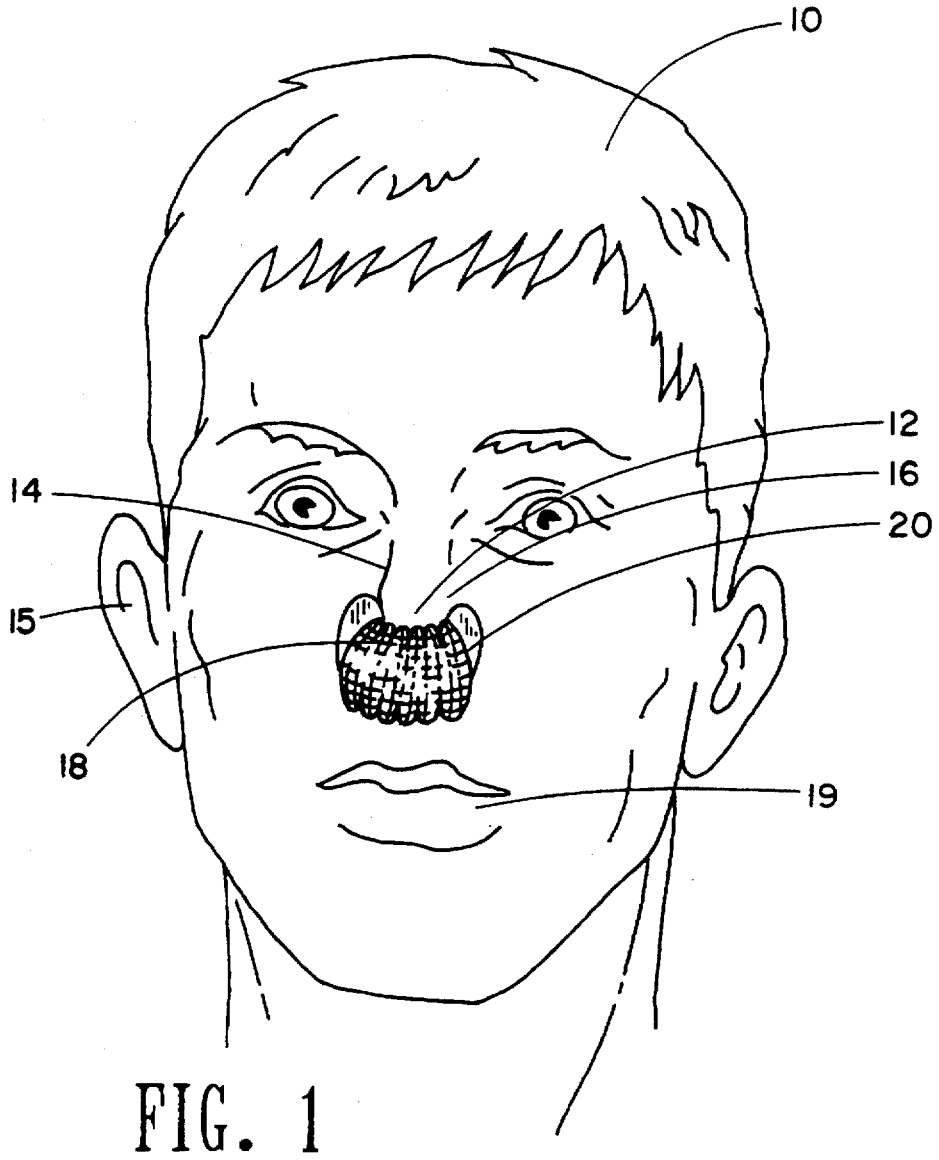
FIG. 1 shows a front elevational view of an individual wearing a disposable nasal band filter.
Figure 2:
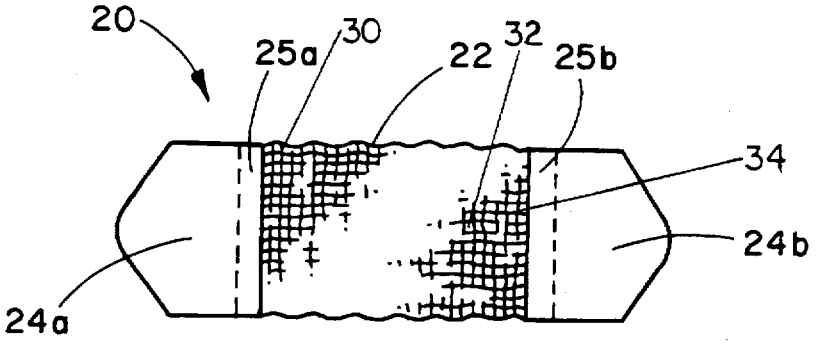
FIG. 2 shows a top view of the disposable nasal band filter.
Figure 3:
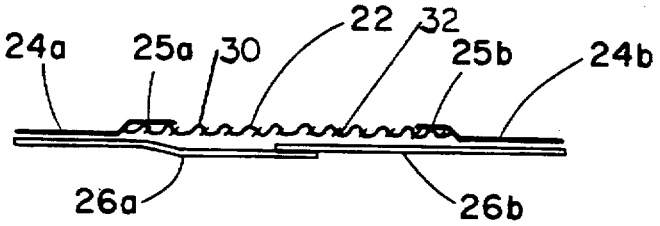
FIG. 3 shows a side view of the disposable nasal band filter shown in FIG. 2.
Figure 4:
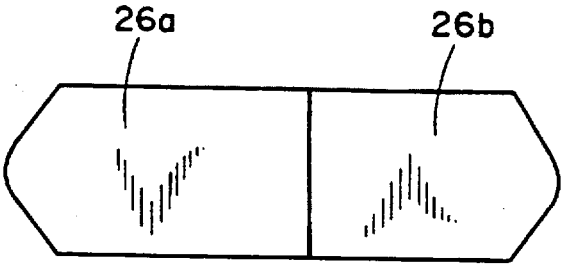
FIG. 4 shows a bottom view of the disposable nasal filter band shown on FIG. 2.
Figure 5:
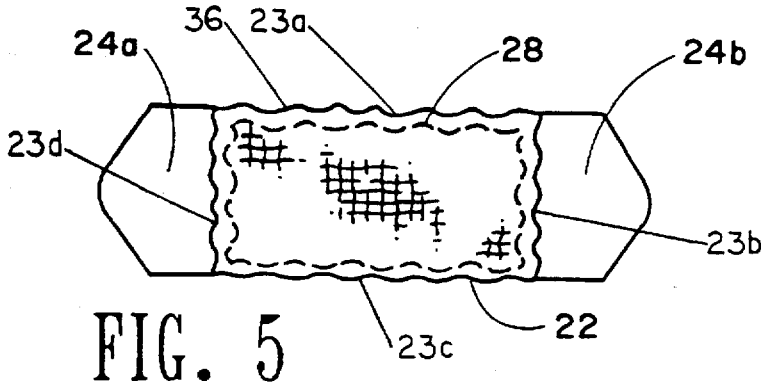
FIG. 5 shows a bottom view of the disposable nasal filter shown in FIG. 2 with the protective backing removed.

Referring to FIG. 1, an individual 10 is shown wearing a DISPOSABLE NASAL BAND FILTER 20 over the nose 12. The DISPOSABLE NASALBAND FILTER 20 fits over the nostrils (not shown), adheres to the sides 14 and 16 of the nose 12, and snuggles above the apex 18 of the nose 12. When the disposable nasal band is in use, the individual is preferably close-mouthed 19 and is breathing only through the nose 12. The elasticity of the nasal band 20 enables it to snuggle the nose and to bulge or become bulbous to allow breathing space surrounding the nostrils (see also FIG. 3A).

Referring to FIGS. 2 through 5, the disposable nasal band 20 includes a central filter element or portion 22 which is preferably made of a thermal fleece or a thermal undergarment material. The thermal undergarment material is made from a well known waffle-woven knit having upraised columns 30 with adjacent depressions 32 of greater prominence than a series of perpendicular upraised rows 34 with shared depressions 32. A sheer adhesive material **24*a* and 24*b* is attached or adhered to each opposite end of the filter portion 22 by overlapping the filter portion 22 with ends 25*a* and 25*b* respectively of the sheer material portions 24*a* and 24*b***.

The sheer adhesive material **24*a* and 24*b* is preferably similar to a tissue paper having an adhesive coating layer on one side so that it will be light weight, non-irritable, breathable through the skin, easy to remove, and non-abrasive for individuals who have sensitive skin or are sensitive to adhesives. The sheer adhesive material 24*a* and 24*b* will have backing 26*a* and 26*b*, respectively, to inhibit exposure of the adhesive side of the sheer adhesive material 24*a* and 24*b* prior to use or between uses of the disposable nasal band 20. The backing 26*a* and 26*b*** may comprise a band-aide covering, paper type, light-weight cardboard, or plastic type material.

The DISPOSABLE NASAL BAND FILTER 20, includes an elastic stitch 28 running through the filter portion 22 around the outer edges **23*a* (upper), 23*b* (right), 23*c* (lower) and 23*d* (left) or periphery of the filter portion 22 such as by stitching the elastic 28 around the outer edges 23*a–d* of the filter portion 22. This causes a gathering effect or gathered portion 36 around the outer edges 23*a–d* (see FIGS. 1, 2, 3A, 5, 6 and 7), causes the filter portion 22 to bulge or a bulging portion 38 (see FIG. 1 and FIG. 3A) and gives the filter portion 22 elasticity. With the combination of the thermal undergarment filter portion 22 and the elastic strand 28, the DISPOSABLE NASALBAND FILTER 20 will seal or prevent open air gaps around the edges, snuggle up to the nose 12 of the user, conform to the nose 12 of the user, bulge to create a gap between the nostrils and the filter portion 22 with the bulge 38 remaining intact during inhaling through the nostrils allowing the user to completely inhale without blockage of the nostrils, allow the filter to remain in place during movement of the upper lip 19, nose 12, etc., and allow for the DISPOSABLE NASAL BAND FILTER 20 to be lifted if the individual needs to sneeze when the DISPOSABLE NASAL BAND FILTER 20 is covering the nose 12 of the individual. The elastic strand 28 could also be employed to gather only the upper and lower outer edges 23***a* and 23*c* which still would create a bulge 38.

Figure 6:
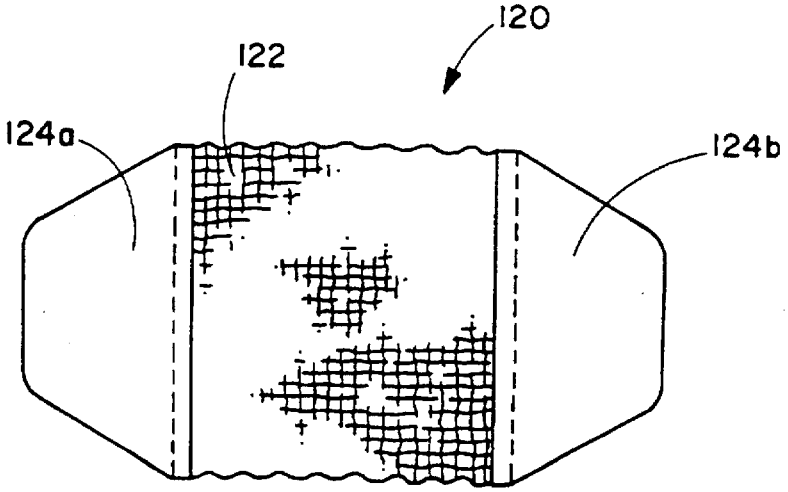
FIG. 6 is a top view of another embodiment of the invention.

Referring to FIG. 6, another embodiment of a DISPOSABLE NASAL BAND FILTER 20 is shown having a central filter portion 122 with sheer adhesive portion 124*a* and 124*b* attached to opposite ends of the filter portion 122. The DISPOSABLE NASAL BAND FILTER 120 shown in FIG. 6 is wider than the DISPOSABLE NASAL BAND FILTER shown in FIG. 2–5 to accommodate a potential user having a nose which requires a greater width or who prefers a larger filter portion for reasons such as increased warmth/insulation from the environment. Otherwise, the DISPOSABLE NASALBAND FILTER 120 shown in FIG. 6 is the same as the embodiment 20 shown in FIG. 2–5.

Figure 7:
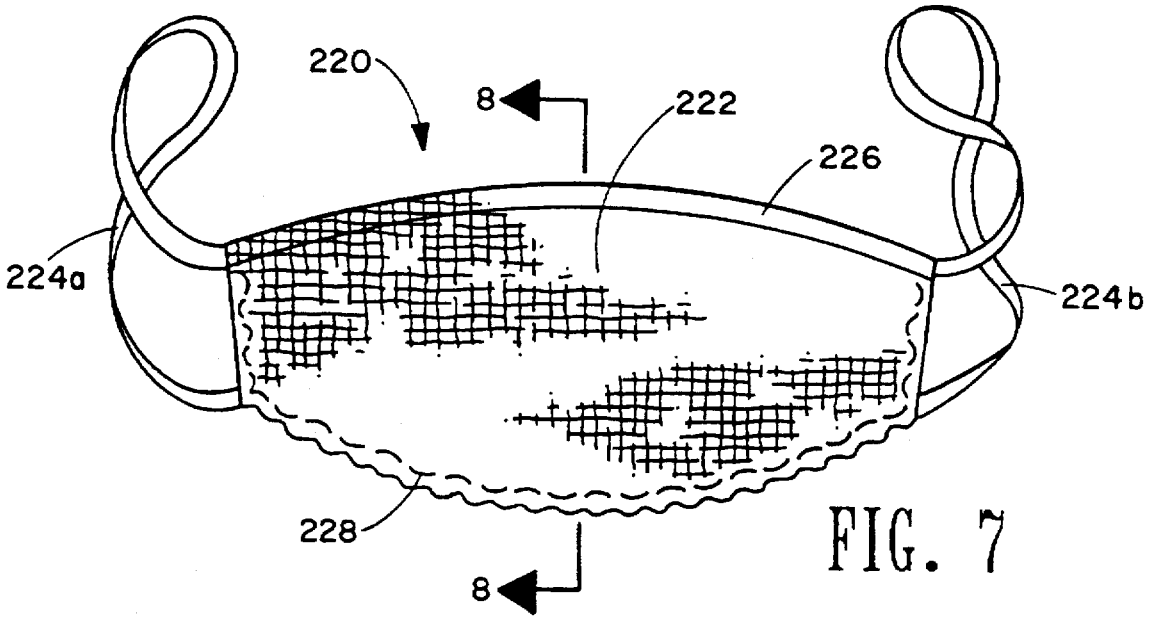
FIG. 7 is a top view of another embodiment of the invention.
Figure 8:
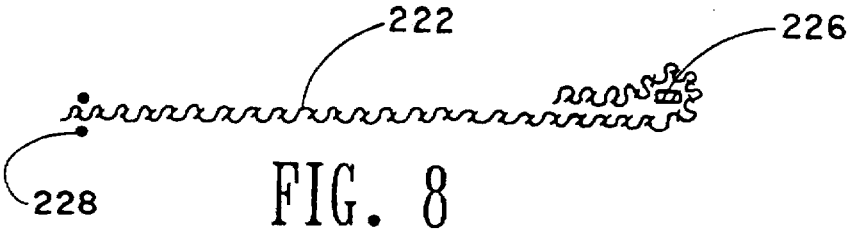
FIG. 8 is a sectional view taken along line 8—8 of FIG. 7.

Referring to FIGS. 7 and 8, another embodiment of a DISPOSABLE NASAL BAND FILTER 220 is shown. In this embodiment the filter portion 222 has elastic bands 224*a* and 224*b* attached respectively to opposite ends of the filter portion 222. The elastic bands 224*a* and 224*b* are for looping around the ears 15 of the user 10 to hold the DISPOSABLE NASAL BAND FILTER 20 in place and over the nose of the user 10. A strand of elastic 228 is stitched across the lower edge of the filter portion 222 and if desired the elastic can be stitched along the edge of the ends where the elastic bands 224*a* and 224*b* are attached to the filter portion 222. In this embodiment 220 the elastic strand 228 is included for the same functional reasons as described above in the embodiment shown on FIG. 2 through FIG. 5. The upper end of the filter portion 222 is folded over and around a metal strip 226 and stitched back to the filter portion 222 to form a packet to hold the metal strip 226 in the filter portion 222. The metal strip 226 is preferably made of pliable type metal and may be a round, flat, and/or rectangular strip, etc. Since the strip is pliable it may be bent to conform to the shape across the bridge and sides 14 and 16 of the users nose 12.

A gauze or other suitable type material with or without the elastic strand 28 can be used in place of the thermal undergarment material in the filter portions 22, 122, 222. However, the thermal undergarment material is presently preferred since gauze is not breathable when it is wet, gauze is harder to breathe through, gauze is not as comfortable, gauze has a tendency to fray, and when inhaled it gets wet and falls apart which inhibits breathing. Comparatively, the thermal fleece material is more durable, breathable, warm, washable, and reusable. One type of sheer adhesive material 24*a* and 24*b* which can be used is "Paper Adhesive Tape" and another is "first aid tape" available from Johnson & Johnson, 3M and other companies which have the added advantage of being hypo-allergenic. Other suitable tape materials may be used. The thermal undergarment material may be 100% cotton or a blend and is available from several sources including UltraTech Fabrics, Inc. of New York, N.Y., style no. DX-#16150.

Figure 3A:
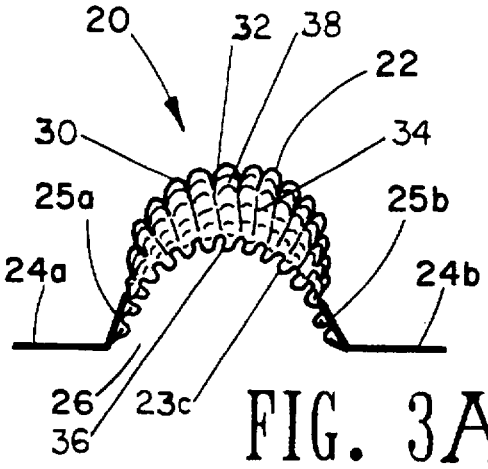
FIG. 3A shows a side elevational view of another embodiment of the invention.

A cellulose acetate type or other suitable filter can be made as a pad or insert (not shown) to be placed within the filter as a liner and held by the disposable nasal band filter against the nose with or without the elastic strand. A cellulose acetate type or other suitable filter material can be a molded semi rigid material having a bulging portion 38 as shown in FIG. 3A but without the gathered portion 36. This molded, more rigid filter could be used as and would appear similar as the filter element 22 in FIG. 3A in place of the thermal undergarment material.

The filter can function as a Delivery System to enhance breathing or to inhibit allergies, etc. by applying prescriptive or non-prescriptive medicinal mists, sprays, drops, powders, etc. to the filter or to the pad (not shown) inserted in the filter. The filter is then placed over the nose. Subsequently, the prescriptive or non-prescriptive medicine is introduced to the respiratory system on inhaling through the nozzles on each successive inhale until the medication is exhausted.

The preferred embodiment of the invention is shown and described. Various departures from the embodiments shown and described can be made without departing from the spirit of the invention as claimed.

What is claimed is:

1. A nasal band filter for wearing on a user's nose and surrounding a user's nostrils, comprising:

a filter element comprising a swatch of thermal undergarment material having an upper, a lower, a right and a left outer edge for surrounding a user's nostrils;

two sheer material pieces having an adhesive coating on one side, wherein each of said sheer material pieces is attached to an opposite end of said filter element;

at least one backing strip covering said sheer material pieces to protect the adhesive coating prior to application of the nasal band filter; and an elastic strand stitched around the upper and the lower outer edges of said filter element such that said filter element includes a gathered portion around the upper, the lower, the right and the left outer edges and a bulging portion whereby said filter element will snuggle a user's nose and define a gap between said filter element and a user's nostrils.

2. The nasal band filter according to claim 1 further including a pliable metal strip set against the upper outer edge of said filter element.

3. The nasal band filter according to claim 1 wherein the elastic strand is further included in the right and the left outer edges of said filter element such that the elastic strand is stitched around a periphery of said filter element.

4. The nasal band filter according to claim 1 further including a pad filter placed within said filter element as a liner.

5. A nasal band filter for wearing on a user's nose and surrounding a user's nostrils, comprising:

a filter element comprising a swatch of thermal undergarment material having an upper, a lower, a right and a left outer edge for surrounding a user's nostrils;

two elastic bands attached to said filter element on the right and the left outer edge of said filter element;

a pliable metal strip set against the upper outer edge of said filter element; and an elastic strand stitched around the lower outer edge of said filter element such that said filter element includes a gathered portion around the lower, outer edge and a bulging portion whereby said filter element will snuggle a user's nose and define a gap between said filter element and a user's nostrils.

* * * * *